US006581565B2

(12) United States Patent
Heslop et al.

(10) Patent No.: US 6,581,565 B2
(45) Date of Patent: Jun. 24, 2003

(54) ENGINE TORQUE CONTROLLER

(75) Inventors: Garon Nigel Heslop, Billericay (GB); Jon Dixon, Maldon (GB); Richard Stephen Blachford, Cambridge (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/191,641

(22) Filed: Jul. 9, 2002

(65) Prior Publication Data

US 2003/0015169 A1 Jan. 23, 2003

(30) Foreign Application Priority Data

Jul. 23, 2001 (EP) ..... 01306301

(51) Int. Cl.[7] ..... F02D 41/14; F02B 17/00

(52) U.S. Cl. ..... 123/295; 123/406.23; 123/406.47; 123/478

(58) Field of Search ..... 123/295, 350, 123/352, 399, 406.23, 406.47, 406.55, 478, 480, 488

(56) References Cited

U.S. PATENT DOCUMENTS

| | | | | |
|---|---|---|---|---|
| 5,638,788 A | * | 6/1997 | Sanvido et al. | 123/339.2 |
| 5,954,026 A | | 9/1999 | Stoss et al. | 123/406.24 |
| 6,047,681 A | | 4/2000 | Scherer et al. | 123/406.46 |
| 6,219,611 B1 | * | 4/2001 | Russell | 123/399 X |
| 6,227,163 B1 | * | 5/2001 | Enoki et al. | 123/295 |
| 6,237,563 B1 | * | 5/2001 | Froehlich et al. | 123/350 |

FOREIGN PATENT DOCUMENTS

DE 42 32 974 A1 4/1994

* cited by examiner

*Primary Examiner*—Tony M. Argenbright
(74) *Attorney, Agent, or Firm*—Brinks Hofer Gilson & Lione

(57) ABSTRACT

This invention relates to an engine torque controller for spark ignition internal combustion engines and more specifically for direct injection engines. The invention provides a torque controller and a method of controlling torque for an engine in which torque is controlled in dependence upon a filtered difference signal where the filtered difference signal is the difference between a desired torque signal and a signal representing an estimate of the current torque.

7 Claims, 3 Drawing Sheets

ENGINE TORQUE CONTROLLER

TECHNICAL FIELD

This invention relates to an engine torque controller for spark ignition internal combustion engines and more specifically for direct injection engines.

BACKGROUND

An engine torque controller is comprised of a torque demand controller and a torque producer. The torque demand controller determines a required target torque, in accordance with an accelerator pedal position, current engine speed, external loads and other factors. This determined torque is then used by the torque producer to produce the desired torque by controlling the spark angle and the air/fuel ratio.

Direct Injection Spark Ignition (DISI) engines inject fuel directly into cylinders where it is ignited by a spark from a spark plug. DISI engines operate in a stratified mode or a homogenous mode. When a DISI engine is in the stratified mode, the combustion chambers contain stratified layers having different air/fuel mixtures. The strata closest to the spark plug contains a stoichiometric mixture, which is a mixture in which the exact amount of air to combust the amount of fuel is present, i.e. when the combustion leaves no excess oxygen or unburned fuel. Subsequent strata contain progressively leaner mixtures. Operation in a stratified mode occurs at lower speeds and lower load conditions.

When the engine is in a homogenous mode, a homogenous mixture of air and fuel is introduced into the combustion chamber. Homogenous operation may be either lean of stoichiometry (i.e. higher air/fuel ratio), at stoichiometry, or rich of stoichiometry (i.e. lower air fuel ratio).

In engine torque controllers for DISI engines, when the engine is operating in stratified mode, spark angle has little influence on the torque produced. The torque producer modifies the air/fuel in order to control the torque produced. Conversely, when the engine is operating in homogenous mode, the air/fuel ratio is controlled tightly in order to maintain correct operation of the catalytic converter to reduce noxious emission. The torque producer modifies the timing of the spark ignition in order to control the torque produced.

A problem occurs in either of these modes of operation when there is a steady state error between the torque demanded and the estimate of the torque produced. In the stratified mode if a fuel adjustment occurs due to such a steady state error then the air/fuel ratio will not be ideal and fuel economy will suffer and performance of the catalytic converter will deteriorate. In the homogenous mode, if the timing of the spark ignition is altered due to such a steady state torque error then the fuel economy will once again suffer and the engine is more likely to stall when a load is imposed. Therefore, there is a need for a method of correction for a steady state error between the torque demanded and an estimate of the torque produced.

SUMMARY

In a preferred embodiment, the engine is a direct injection spark ignition engine and the transient torque controller is arranged to receive a combustion mode signal indicating whether the engine is operating in a stratified mode or a homogeneous mode. If the signal indicates that the engine is operating in the stratified mode then the fuel and spark controller is arranged to control the fuel adjustment signal. If the signal indicates that the engine is operating in the homogeneous mode then the fuel and spark controller is arranged to control the spark adjustment signal.

Preferably, the controller also has an air charge controller arranged to receive an air charge demand signal, a throttle position signal, an engine speed signal, a manifold pressure signal and an air charge temperature signal and arranged to output the estimated air charge signal. Preferably, there is also an air charge demand controller arranged to receive the desired torque signal, a desired spark angle signal and a desired air/fuel ratio signal and to output the air charge demand signal.

According to another aspect of the invention, there is provided a method of controlling torque for an engine. The method includes estimating a current torque signal in dependence upon a received current spark angle signal, a received current air/fuel ratio signal and a received estimated air charge signal, comparing the estimated current torque signal with a desired torque signal to provide a difference signal, and filtering low frequency components from the difference signal. Finally, controlling a fuel adjustment signal and a spark adjustment signal in dependence upon the filtered difference signal.

These and other aspects and advantages of the present invention will become apparent upon reading the following detailed description of the invention in combination with the accompanying figures.

DETAILED DESCRIPTION

Figure 1:
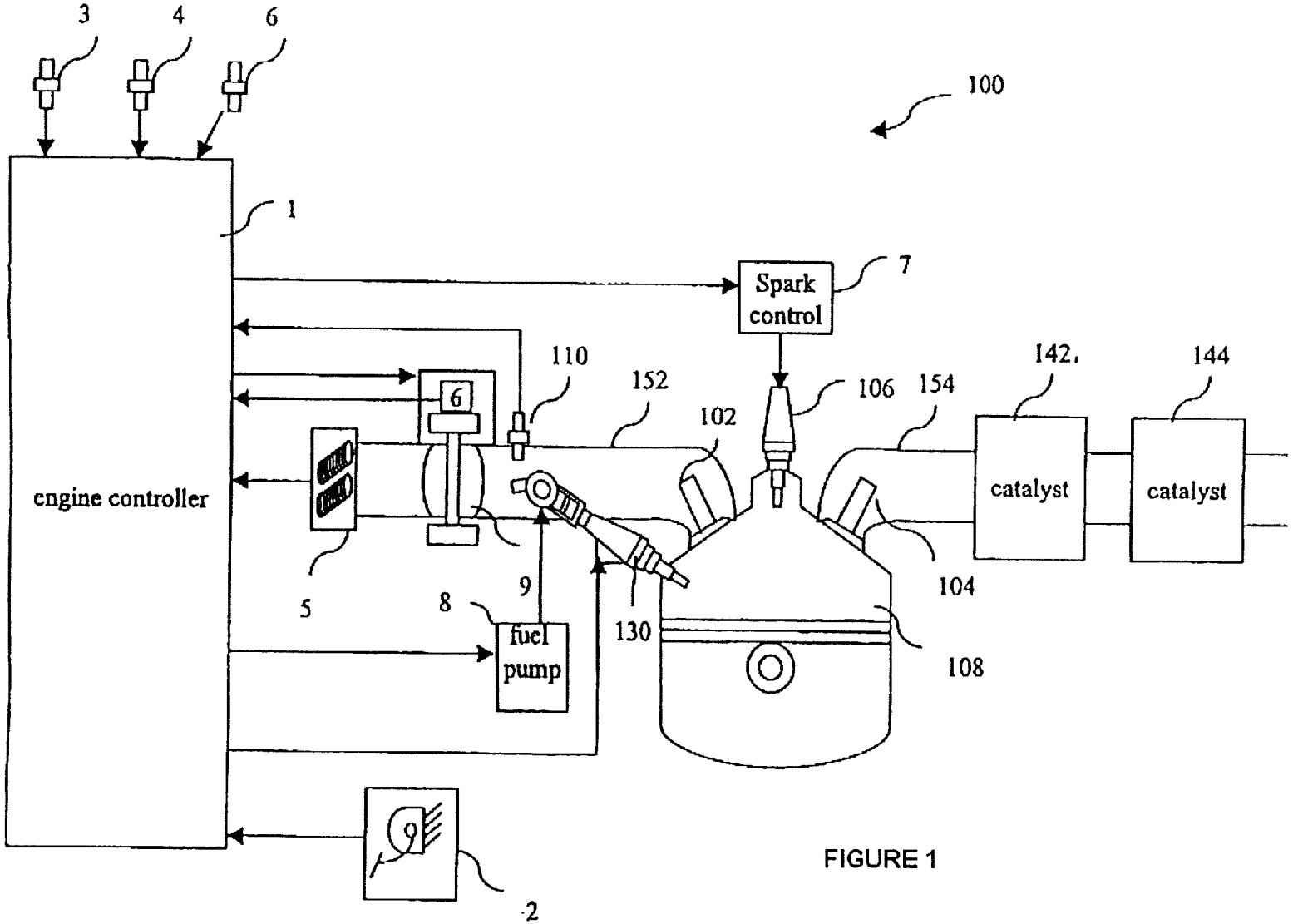
FIG. 1 is a block diagram illustrating part of an engine and an engine controller, in accordance with the present invention.

FIG. 1 illustrates an embodiment of a direct injection spark ignition engine 100 which has an engine controller 1. The engine controller 1 receives signals from an accelerator pedal and sensor assembly 2, an engine speed sensor 3, an engine temperature sensor 4, an air charge temperature sensor 5, a manifold absolute pressure sensor 110 and a throttle position indicator 6.

A fuel injector 130 injects fuel directly into a combustion chamber 108. The injected fuel mixes with an air charge which enters through an air intake valve 102 via an air intake manifold 152. The air charge is controlled by a throttle 9 and the fuel injected is controlled by a fuel pump 8. A spark control unit 7 controls a spark plug 106, to generate a spark for ignition of the air/fuel mixture. Exhaust gases from the resulting combustion exit via an exhaust valve 104 into an exhaust manifold 154. The exhaust manifold 154 has a three way catalytic converter 142 and a Nox trap/catalyst 144.

Figure 2:
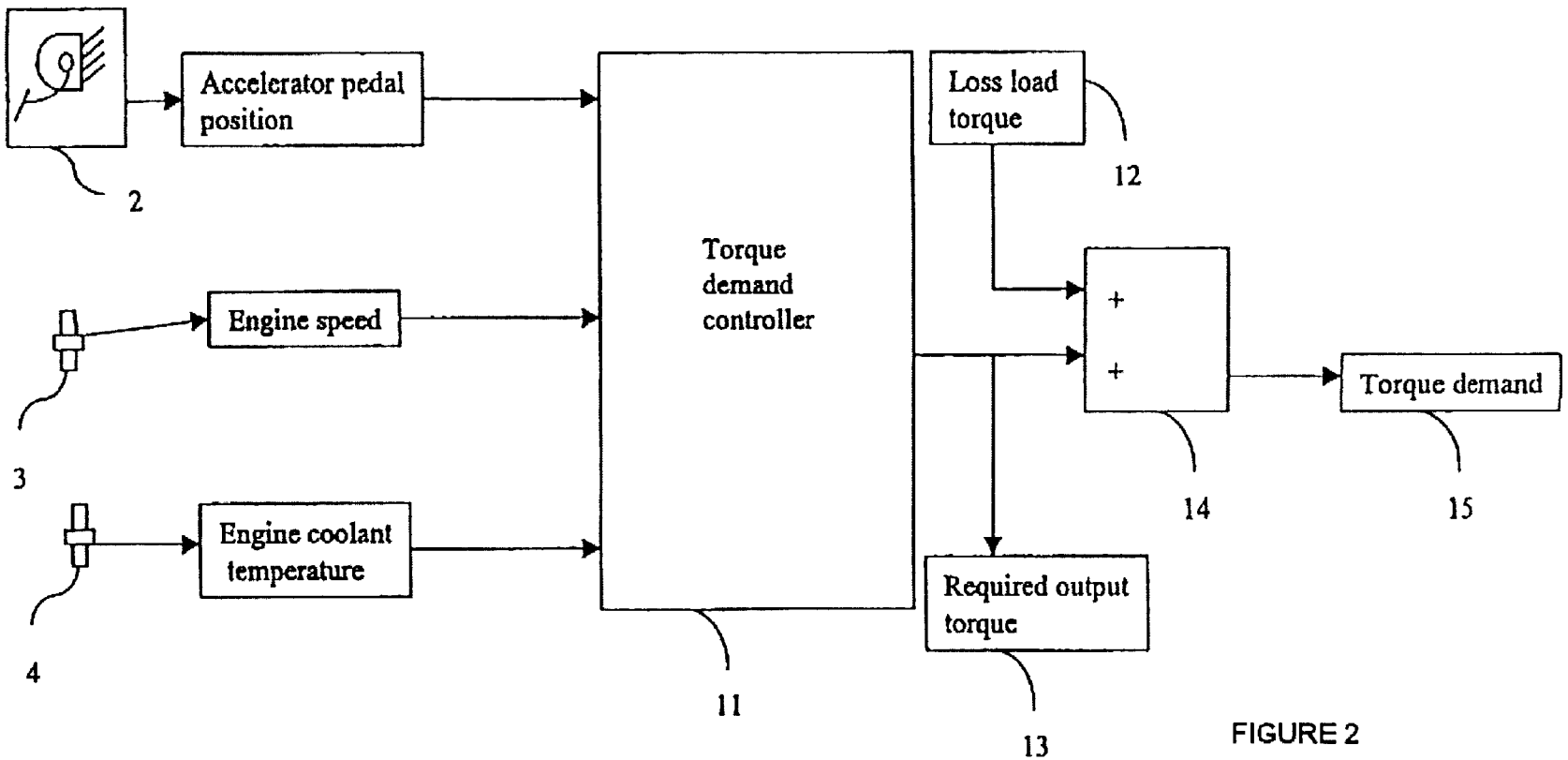
FIG. 2 is a block diagram of a torque demand controller, in accordance with the present invention.

FIG. 2 illustrates an embodiment of a torque demand controller 11 that is part of the engine controller 1. The torque demand controller 11 calculates a required output torque signal 13, based on an accelerator pedal position signal received from the accelerator pedal and sensor assembly 2, an engine speed signal received from the engine speed sensor 3 and an engine temperature signal received from the engine temperature sensor 4. A loss load torque signal 12, which represents losses due to losses in the engine and powertrain system, is added to the required output torque signal 13 by an adder 14 to generate a torque demand signal 15.

Figure 3:
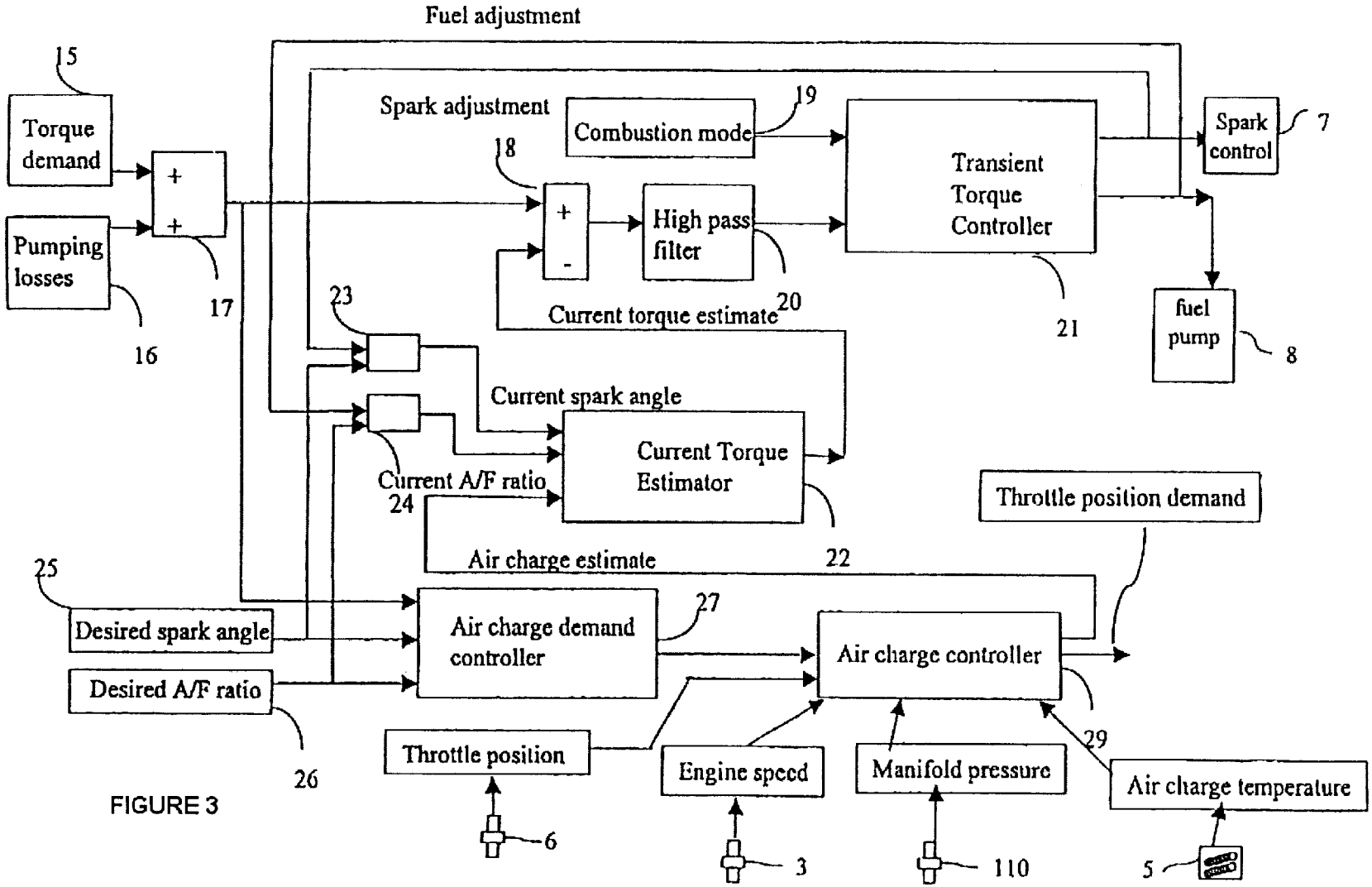
FIG. 3 is a block diagram of a torque producer, in accordance with the present invention.

Referring now to FIG. 3, an adder 17 receives as inputs the torque demand signal 15 and a pumping losses signal 16, which represents losses due to the inherent losses in the engine cycle (i.e. due to the energy required to draw air in and to push out exhaust gases). The adder 17 outputs a desired torque signal.

An air charge demand controller 27 receives as inputs the desired torque signal, a desired spark angle signal 25 and a desired air fuel ratio signal 26. The desired spark angle signal 25 and the desired air fuel ratio signal 26 are calculated elsewhere in the engine controller 1 and depend upon signals such as engine speed, engine load and engine temperature.

The air charge demand controller 27 generates an air charge demand signal that is received by an air charge controller 29. The air charge controller 29 also receives as inputs a signal indicating throttle position that is received from the throttle position indicator 6 (FIG. 1), the engine speed sensor 3, the manifold absolute pressure sensor 110 and the air charge temperature meter 5. The air charge controller 29 generates a signal indicating desired throttle position that is sent to throttle 9 (FIG. 1) and a signal representing an estimate of the air charge.

The estimated air charge may be different from the air charge demanded by the air charge demand controller 27 due to delays in the engine 100, such as the time taken for the throttle 9 to move, the time taken for the pressure in the air intake manifold 152 to rise or fall, or any errors in position of the throttle. The air charge estimate signal is sent to a current torque estimator 22.

The current torque estimator 22 uses the air charge estimate signal, together with a signal representing the current spark angle and a signal representing the current air/fuel ratio to generate a signal representing an estimate of the current torque.

The estimate of the current torque is compared to the desired torque signal by a comparator 18 to generate an error signal which is then filtered by a high pass filter 20. The resulting filtered error signal is used by a transient torque controller 21 to generate signals for temporarily adjusting the torque produced by the engine 100.

A combustion mode signal 19, which is produced elsewhere in the engine controller 1, indicates whether the engine 100 is operating in a stratified mode or in a homogenous mode. If the engine 100 is operating in the stratified mode then a fuel adjustment signal is generated and sent to the fuel pump 8 in order to adjust the amount of fuel which is injected into the combustion chamber 108 by the fuel injector 130. If the engine 100 is operating in the homogenous mode then a spark adjustment signal is generated and sent to the spark control unit 7 to adjust the timing of the ignition spark generated by the spark plug 106.

The signal representing the current spark angle is calculated by a calculator 23 using the desired spark angle and any spark adjustment signal received from the transient torque controller 21. The signal representing the current air fuel ratio is calculated by a calculator 24 using the desired air fuel ratio and any fuel adjustment signal received from the transient torque controller 21. When the engine 100 is operating in stratified mode the current spark angle will be equal to the desired spark angle 25. When the engine 100 is operating in homogenous mode the current air/fuel ratio will be equal to the desired air fuel ratio 26.

As any person skilled in the art of systems and methods of controlling the torque output of an engine will recognize from the previous detailed description and from the figures and claims, modifications and changes can be made to the preferred embodiments of the invention without departing from the scope of this invention defined in the following claims.

What is claimed is:

1. A device for controlling a torque output of an engine, the device comprising:

a torque demand controller for generating a torque demand signal; and a torque producer which receives the torque demand signal, the torque producer includes:

an estimator which receives as inputs a current spark angle signal, a current air/fuel ratio signal and an estimated air charge signal and outputs an estimated torque signal;

a comparator which receives as inputs the estimated torque signal and a desired torque signal and outputs a difference signal;

a high pass filter which receives as an input the difference signal and outputs a filtered difference signal in which low frequency components are absent; and a transient torque controller which receives as an input the filtered difference signal and outputs a fuel adjustment signal and a spark adjustment signal.

2. The device in claim 1, wherein the estimated air charge signal is produced by an air charge controller which receives as inputs an air charge demand signal, a throttle position signal, an engine speed signal, a manifold pressure signal and an air charge temperature signal.

3. The device in claim 2, wherein the air charge demand signal is produced by an air charge demand controller which receives as inputs the desired torque signal, a desired spark angle signal and a desired air/fuel.

4. The device of claim 1, in which the engine is a direct injection spark ignition engine, wherein the transient torque controller is arranged to receive a combustion mode signal indicating whether the engine is operating in a stratified mode or a homogeneous mode, and wherein the transient torque controller is arranged to control the fuel adjustment signal when the combustion mode signal indicates that the engine is operating in the stratified mode, and wherein the transient torque controller is arranged to control the spark adjustment signal when the combustion mode signal indicates that the engine is operating in the homogeneous mode.

5. The device in claim 4, wherein the estimated air charge signal is produced by an air charge controller which receives as inputs an air charge demand signal, a throttle position signal, an engine speed signal, a manifold pressure signal and an air charge temperature signal.

6. The device in claim 5, wherein the air charge demand signal is produced by an air charge demand controller which receives as inputs the desired torque signal, a desired spark angle signal and a desired air/fuel.

7. A method for controlling a torque output of an engine, the method comprising:

estimating a current torque signal from a received current spark angle signal, a received current air/fuel ratio signal and a received estimated air charge signal;

comparing the estimated current torque signal with a desired torque signal to output a difference signal;

filtering out a plurality of low frequency components from the difference signal; and controlling a fuel adjustment signal and a spark adjustment signal in dependence upon a filtered difference signal.

* * * * *

UNITED STATES PATENT AND TRADEMARK OFFICE

CERTIFICATE OF CORRECTION

PATENT NO. : 6,581,565 B2
DATED : June 24, 2003
INVENTOR(S) : Garon N. Heslop et al.

It is certified that error appears in the above-identified patent and that said Letters Patent is hereby corrected as shown below:

Column 4,
Lines 30 and 53, after "air/fuel" insert -- ratio -- before "." (period).

Signed and Sealed this

Twenty-eighth Day of October, 2003

JAMES E. ROGAN
*Director of the United States Patent and Trademark Office*